United States Patent [19]

Kondo

[11] Patent Number: 4,646,478

[45] Date of Patent: Mar. 3, 1987

[54] SEAL STRUCTURE BETWEEN RESPECTIVE END PORTIONS OF CURTAIN WALL UNITS AND BUILDING WALL

[75] Inventor: Hiroshi Kondo, Kurobe, Japan

[73] Assignee: Yoshida Kogyo K.K., Tokyo, Japan

[21] Appl. No.: 611,076

[22] Filed: May 17, 1984

[30] Foreign Application Priority Data

May 18, 1983 [JP] Japan ..... 58-73134[U]

[51] Int. Cl.[4] ..... E04H 1/00

[52] U.S. Cl. ..... 52/235

[58] Field of Search ..... 52/235, 403

[56] References Cited

U.S. PATENT DOCUMENTS 3,380,210 4/1968 Neal et al. ..... 52/235
4,506,482 3/1985 Pracht et al. ..... 52/403 X
57-27012 2/1982 JPX .

FOREIGN PATENT DOCUMENTS 57-27012 2/1982 Japan .

*Primary Examiner*—Carl D. Friedman
*Attorney, Agent, or Firm*—Hill, Van Santen, Steadman & Simpson

[57] ABSTRACT

A seal structure between a building wall and respective end portions of a plurality of curtain wall units, in which the curtain wall units (A) are mounted and disposed continuously as predetermined intervals in the vertical and the horizontal directions and have an opposed relation to the building wall (B) so as to constitute a unit type curtain wall, and in which a plurality of packing members (1) are interposed vertically and continuously between the building wall (B) and the respective end portions ($A_1$ or $A_2$) of the units (A). The bottom end portion of the packing members (1) is inserted into a space (D) which is separated water-tightly from an indoor side portion of the unit type curtain wall and which is opened to the outdoor side thereof through a drain hole (4).

3 Claims, 4 Drawing Figures

SEAL STRUCTURE BETWEEN RESPECTIVE END PORTIONS OF CURTAIN WALL UNITS AND BUILDING WALL

BACKGROUND OF THE INVENTION

1. Field of the invention:

This invention relates to a seal structure for keeping air- and water-tight between respective end portions of a plurality of curtain wall units forming a unit type curtain wall and a building wall.

2. Description of the prior art:

As disclosed in Japanese Utility Model Laid-open (Provisional) Publication No. Sho 57-27012, there has been known a seal structure in which respective end portions of a plurality of upper and lower curtain wall units forming a unit type curtain wall are connected by a connecting member and indoor- and outdoor-side caulkings are applied between those end portions and a building wall to form vertical hollow chambers. Further, a caulking for interconnecting the indoor- and outdoor-side caulking is applied to make independent each hollow chamber formed between each end portion of the curtain wall unit and the building wall, which hollow chamber is opened to the outdoor side.

According to such a seal structure, it is possible to prevent rain water, etc. from entering the indoor side from between the end portions of the curtain wall units and the building wall, but since the indoor- and outdoor-side caulkings as well as the caulking for interconnecting both caulkings must be applied, the executive operations therefore are troublesome. Besides, because the execution of the caulkings is performed in the building site, it is likely that there will occur an execution error, etc., thus impairing reliability.

Particularly, since the caulking for interconnecting the indoor- and outdoor-side caulkings must be applied into a narrow space between the end portions of the curtain wall units and a building wall, the executive operations therefore are extremely troublesome.

SUMMARY OF THE INVENTION

It is an aim of the present invention to provide a seal structure capable of surely preventing rain water, etc. from entering the indoor side from a vertically extending space formed between respective end portions of a plurality of curtain wall units and a building wall, permitting a simple and easy executive operations therefore and further permitting a smooth discharge to the outdoor side of rain water, etc. entering between the end portions of the curtain wall units and the building wall.

In order to achieve the foregoing aim, according to a first aspect of the present invention, there is provided a seal structure between a building wall and respective end portions of a plurality of curtain wall units disposed oppositely to the building wall and continuously in the vertical and horizontal directions at a certain distance to one another so as to constitute a unit type curtain wall, characterized in that a plurality of packing members are closely interposed between the building wall and the respective end portions of the curtain wall units and extend continuously in the vertical direction along a vertically extending space formed between the building wall and the end portions of the curtain wall units.

According to a second aspect of the present invention, there is provided a seal structure between a building wall and respective end portions of a plurality of curtain wall units disposed oppositely to the building wall and continuously in the vertical and the horizontal directions at a certain distance to one another so as to constitute a unit type curtain wall, characterized in that, in the first aspect, each upper part of each of the packing members extends to a lower end portion of a curtain wall unit disposed at the just above position and is bent on the indoor side of the curtain wall, while each lower part of each of the packing members extends to an upper end portion of a curtain wall unit disposed at the just below position and is bent on the outdoor side of the curtain wall, and each upper part of each one of the packing members and each lower part of each the other of the packing members are pressurizedly contacted to each other.

Further, according to a third aspect of the present invention, there is provided a seal structure between a building wall and respective end portions of a plurality of curtain wall units disposed oppositely to the building wall and continuously in the vertical and the horizontal directions at a certain distance to one another so as to constitute a unit type curtain wall, characterized in that, in the said second aspect, the bottom bent part of the lowermost packing member mounted between the bottom curtain wall unit and the building wall is inserted into a space water-tightly separated from the indoor side of the curtain wall and formed by a throating and a water-proofed sheet disposed between the bottom unit and a facing wall of the building.

Still further, according to a fourth aspect of the present invention, there is provided a seal structure between a building wall and respective end portions of a plurality of curtain wall units disposed oppositely to the building wall and continuously in the vertical and the horizontal directions at a certain distance to one another so as to constitute a unit type curtain wall, characterized in that, in the third aspect, the throating is provided with a drain hole for opening the water-tightly separated space into the outdoor side of the curtain wall.

Further, according to a fifth aspect of the present invention, there is provided a seal structure between a building wall and respective end portions of a plurality of curtain wall units disposed oppositely to the building wall and continuously in the vertical and the horizontal directions at a certain distance to one another so as to constitute a unit type curtain wall, characterized in that the said seal structure further comprises a plurality of packing members closely interposed between an inner surface of the building wall and respective end faces of the curtain wall units and extending continuously in the vertical direction along a vertically extending space formed between the inner building-wall surface and the respective end faces of the curtain wall units, an outdoor-side caulking closely interposed through a backup member between one end of a corner frame member of the unit type curtain wall and an outdoor-side vertical end member thereof and extending continuously in the vertical direction alon a vertically extending space formed between the corner frame member and the outdoor-side vertical end member, and an indoor-side caulking interposed through a backup member between the inner surface of the building wall and an indoor-side vertial end member of the unit type curtain wall and extending continuously in the vertical direction along a vertically extending space formed between the inner building-wall surface and the indoor-side vertical end member, wherein the plurality of packing members are disposed between the outdoor-side and the indoor-side caulkings and spaced apart form both the caulkings.

The above and many other advantages, features and additional aspects of the present invention will become manifest to those versed in the art upon making reference to the following detailed description and accompanying drawings in which preferred structural embodiment incorporating the principles of the present invention are shown by way of illustrative example.

DETAILED DESCRIPTION OF A PREFERRED EMBODIMENT

Figure 1:
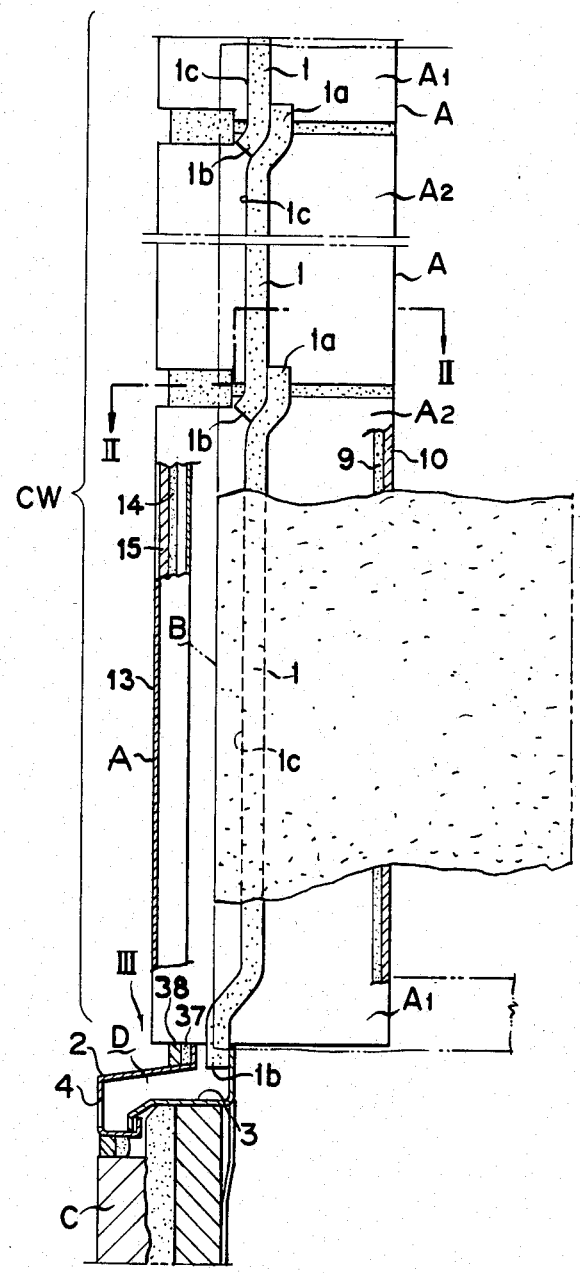
FIG. 1 is a fragmentary schematic side view showing a mounted state of aplurality of curtain wall units forming a unit type curtain wall mounted on a building wall.

FIG. 1 is a schematic side view showing a mounted state of a plurality of curtain wall units, in which the curtain wall units A are mounted and disposed continuously in the vertical and the horizontal directions at a certain distance to one another to constitute a unit type curtain wall CW.

In FIG. 1, only a vertically continuous fragmentary part of the unit type curtain wall CW is shown.

Between respective end portions $A_1$ of the units A and a building wall B are interposed continuously in the vertical direction a plurality of packing members 1 to provide a seal therebetween. An upper part 1*a* of each packing member 1 is bent to the indoor side and extends up to the lower end portion $A_1$ of the overlying unit A, while a lower part 1*b* of each packing member 1 is bent on the outdoor side and extends up to the upper end portion $A_2$ of the underlying unit A, where it is in pressure contact with the outdoor side of the upper bent portion 1*a*, to thereby provide a seal between the connection of the upper and lower units A and the building wall B.

The lower bent part 1*b* of the packing member 1 attached to the bottom unit A is inserted into the interior of a space D which is defined by a drip member 2 and a water-proofed sheet 3, both disposed between an outer decorative facing wall C of the building and the lower portion of the bottom unit A and which is separated water-tightly from the indoorside. Further, a drain hole 4 is formed in the drip member 2 to open the space D on the outer side, whereby rain water or the like entering between the lower end portion $A_1$ of the bottom unit A and the building wall B flows down into the space D along respective outdoor sides 1*c* of the packing members 1 and is drained the outdoor side through the drain hole 4, thus being prevented from entering the indoor side of the curtain wall.

Figure 2:
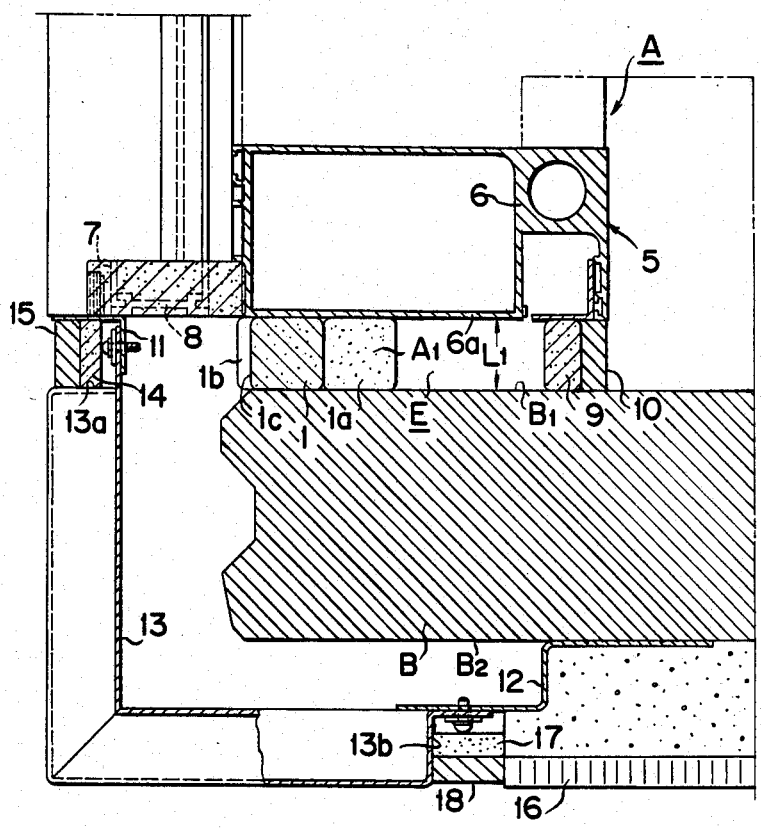
FIG. 2 is a sectional detailed view taken along line II—II of FIG. 1.

FIG. 2 is a sectional detailed view taken along line II—II of FIG. 1, in which a vertical end member 5 of the unit A comprises an indoor-side vertical member 6 and an outdoor-side vertical end member 7 which are connected through a space holder 8 formed of a heat insulating material, and between an outer wall 6*a* of the indoor-side vertical end member 6 and an inner surface $B_1$ of the building wall B are interposed the packing members 1 on the outdoor side, while on the indoor side is applied a caulking 10 through a backup member 9.

An angle member 11 is fixed to an end portion of the outdoor-side vertical end member 7 and a mounting member 12 is fixed to an outer surface $B_2$ of the building wall B, and a corner frame member 13 extends over both the mounting member 12 and the angle member 11. Further, between one end 13*a* of the corner frame member 13 and the outdoor-side vertical member 7 is applied a caulking 15 through a backup member 14, while between the opposite end 13*b* of the corner frame member 13 and an outer decorative panel 16 is applied a caulking 18 through a backup member 17.

A space E is formed between the outer wall 6*a* of the indoor-side vertical end member 6 and the inner surface $B_1$ of the building wall B. Its space $L_1$ (i.e., the distance between the outer wall 6*a* and the inner surface $B_1$) is set at a value capable of absorbing relative displacements of the unit A in the vertival and the transverse directions with respect to the curtain wall plane caused by earthquake, thermal expansion, etc.

Figure 3:
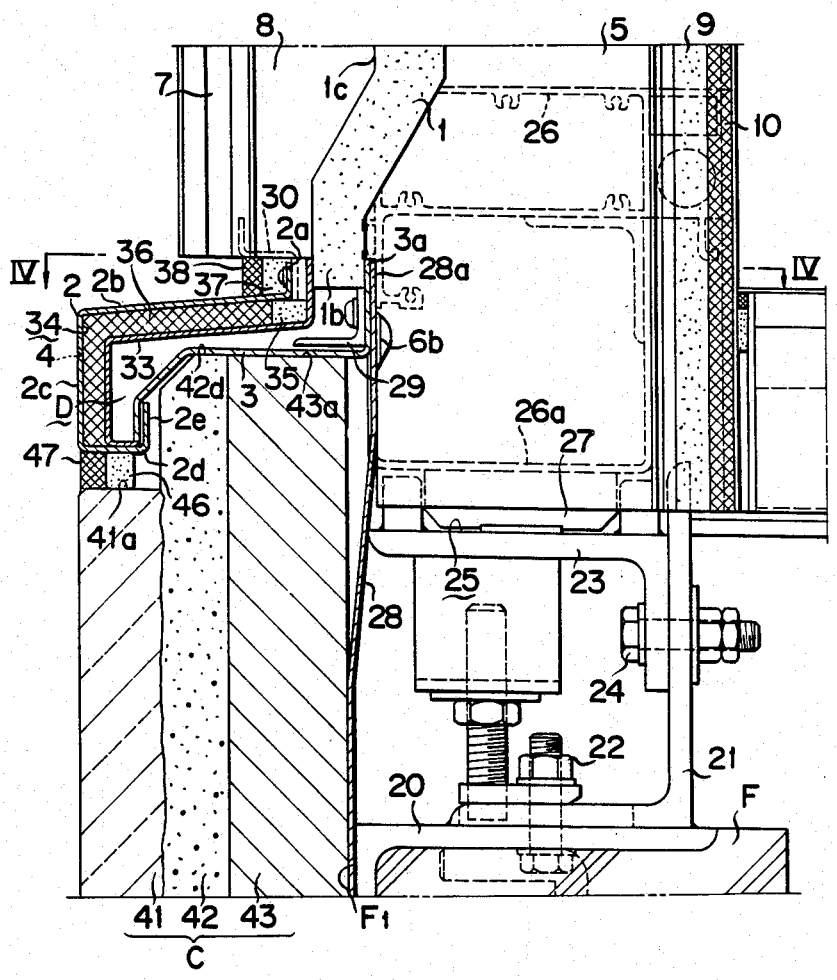
FIG. 3 is an enlarged detailed view of the portion generally indicated by arrow III of FIG. 1.
Figure 4:
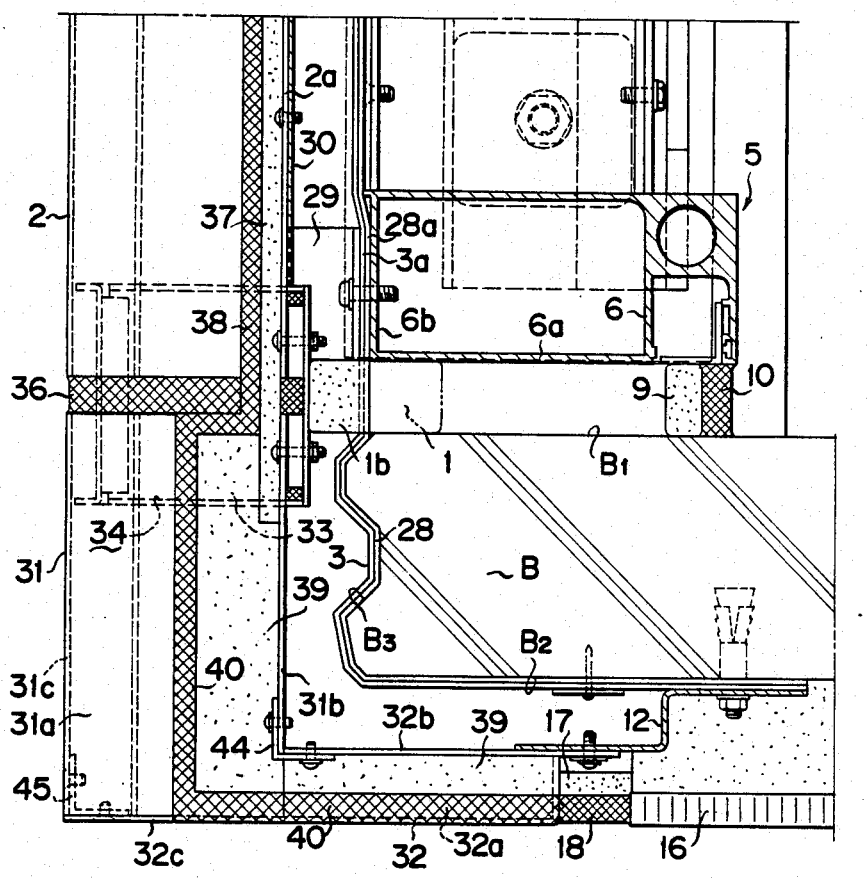
FIG. 4 is a sectional view taken along line IV—IV of FIG. 3.

Referring now to FIGS. 3 and 4, which are an enlarged detailed view of the portion generally indicated by arrow III of FIG. 1 and a sectional view taken along line IV—IV of FIG. 3, respectively, the lower portion of the indoor-side vertical end member 6 projects lower than the lower portions of the space holder 8 and outdoor-side vertical end member 7 and is positioned above a building foundation F. Onto the upper portion of the building foundation F is fixed to a primary fastener 20 is fixed a secondary fastener 21 with bolt and nut 22, and onto the secondary fastener 21 is fixed a tertiary fastener 23 with bolt and nut 24. Further, in an upward recess 25 of the tertiary fastener 23 is fitted a block 27, the block 27 being fixed to a lower wall 26*a* of a lower horizontal member 26 which is connected to the indoor-side vertical end member 6, and the lower portion of the unit A is connected to the building foundation F through the fasteners 20, 21 and 23.

A damp-proofed sheet 28 is mounted over both an outdoor-side wall 6*b* of the projecting portion of the indoor-side vertical end member 6 and an outdoor-side face $F_1$ of the building foundation F. The damp-proofed sheet 28 as well as the water-proofed sheet 3 extend over both an outdoor-side face $B_3$ and outer face $B_2$ of the building wall B, and an end portion of the damp-proofed sheet 28 is fixed to the outer face $B_2$ of the building wall B by means of the mounting member 12.

Upper end portions 28*a* and 3*a*, respectively, of the damp-proofed sheet 28 and the the water-proofed sheet 3 are held in pressure contact with the outdoor-side wall 6*b* of the projecting portion of the indoor-side vertical end member 6 through a mounting piece 29.

The drip member 2 comprises a rising portion 2*a*, an inclined portion 2*b*, an outdoor vertical portion 2*c*, an inward portion 2*d* and a rising portion 2*e*, the rising portion 2*a* being connected to the outdoor-side vertical end member 7 through a mounting member 30. Continuously to the drip member 2 are mounted an end drip member 31 and a side drip member 32, and a caulking receiver 33 is mounted over both the drip member 2 and the end drip member 31. Further, a space 34 is formed between the caulking receiver 33 and the backs of the drip member 2 and end drip member 31, and a caulking 36 is applied to the space 34 through a backup member 35 to provide a seal between opposed ends of the drip member 2 and the end drip member 31.

Between the lower portion of the indoor-side member 6 and the drip member 2 is applied a caulking 38 through a backup member 37, and a caulking 40 is applied through a backup member 39 over the lower portion of the corner frame member 13 as well as an inclined portion 31*a* of the end drip member 31 and an inclined portion 32*a* of the side drip member 32, the caulking 40 being contiguous to the caulking 38.

The outer decorative facing wall C of the building comprises a style strip 41, a mortar layer 42 and a heat insulating panel 43, with the inward portion 2*d* of the drip member 2 being positioned above the style strip 41*a*. Further, an end portion of the water-proofed sheet 3 is in abutment with the inward portion 2*d*, and the water-proofed sheet 3 covers both an upper surface 42*a* of the mortar layer and an upper surface 43*a* of the heat insulating panel to prevent the entry of rain water, etc. into the outer decorative facing wall C. In addition, the damp-proofed sheet 28 prevents damp from being transmitted to the indoor side along the outer decorative facing wall C.

In FIGS. 3 and 4, the numeral 44 denotes a connector for connection between a rising portion 31*b* of the end drip member 31 and a rising portion 32*b* of the side drip portion 32; numeral 45 represents a connector for connection between outdoor vertical portions 32*c* and 31*c*; numeral 46 denotes a backup member; and numeral 47 represents a caulking.

What is claimed is:

1. A seal structure between a building wall and respective end portions of a plurality of curtain wall units facing the building wall and continuous in the vertical and the horizontal directions at a certain distance to one another so as to constitute a unit type curtain wall, characterized in that a plurality of packing members are closely interposed between the building wall and the respective end portions of the curtain wall units and extend continuously in the vertical direction along a vertically extending space formed between the building wall and the respective end portions of the curtain wall units, each upper part of each of the packing members extends up to a lower end portion of an overlying curtain wall unit, while each lower part of each of the packing members extends down to an upper end portion of an underlying curtain wall unit and is bent on the indoor side of the curtain wall, while each lower part of each of the packing members extends to an upper end portion of a overlying curtain wall unit and is bent on the outdoor side of the curtain wall, and each upper part of each one of the packing members and each lower part of each other of the packing members are pressurizedly contacted to each other.

2. A seal structure as claimed in claim 1, characterized in that the bottom bent part of the lowermost packing member mounted between the bottom curtain wall unit and the building wall is inserted into a space water-tightly separated from the indoor side of the curtain wall, said space formed between a drip member and a water-proofed sheet which are disposed between the bottom unit and an outer decorative facing wall of the building.

3. A seal structure as claimed in claim 2, characterized in that the drip member is provided with a drain hole for opening the water-tightly separated space to the outdoor side of the curtain wall.

* * * * *